United States Patent [19]

Shelangoskie et al.

[11] Patent Number: 4,583,336

[45] Date of Patent: Apr. 22, 1986

[54] JOINT OF PREFORMED CONCRETE ELEMENTS

[75] Inventors: Donald R. Shelangoskie, Richmond Heights; Jack H. Brown, Mentor; Eric K. Jacobsen, Chagrin Falls; Patrick A. Masterson, Mayfield Heights; Ricky A. Pierce, Mentor; Barry A. Rogers, South Euclid; Lawrence J. Valentine, Chagrin Falls, all of Ohio

[73] Assignee: The Austin Company, Cleveland, Ohio

[21] Appl. No.: 666,179

[22] Filed: Oct. 29, 1984

[51] Int. Cl.[4] ..... E04B 1/16

[52] U.S. Cl. ..... 52/250; 52/283; 52/573

[58] Field of Search ..... 52/295, 573, 167, 283, 52/259, 250–253, 393; 14/15, 16.1

[56] References Cited

U.S. PATENT DOCUMENTS

| | | | |
|---|---|---|---|
| 1,334,519 | 3/1920 | Bushong | 52/295 |
| 2,335,433 | 11/1943 | Minck | 72/16 |
| 2,396,045 | 3/1946 | Henderson | 52/283 |
| 3,484,882 | 12/1969 | Blanchette | 14/16.1 |
| 3,691,712 | 9/1972 | Bowling et al. | 52/573 |
| 3,852,931 | 12/1974 | Morse et al. | 52/293 |
| 4,030,262 | 6/1977 | Dean | 52/595 |
| 4,094,111 | 6/1978 | Creegan | 52/167 |
| 4,107,889 | 8/1978 | Gonsalves | 52/259 |
| 4,162,596 | 7/1979 | Damman | 52/295 |

FOREIGN PATENT DOCUMENTS

| | | | |
|---|---|---|---|
| 642707 | 9/1950 | United Kingdom | 52/295 |
| 372331 | 4/1973 | U.S.S.R. . | |

*Primary Examiner*—James L. Ridgill, Jr.
*Attorney, Agent, or Firm*—Robert F. Hause

[57] ABSTRACT

Improved connections of preformed concrete construction elements wherein one or more metal pins, of any preferred cross-sectional shape, are cast in place, or grouted, extending into each of two elements to be connected, with an elastic grommet disposed between a portion of each pin, in an area on each pin nearest the joint, and the surrounding concrete or grout, whereby the load transfer capacity of the connection is increased about threefold.

12 Claims, 7 Drawing Figures

JOINT OF PREFORMED CONCRETE ELEMENTS

BACKGROUND OF THE INVENTION

This invention relates to an improvement in connections of precast concrete articles, such as girders, beams, columns or plates and particularly to building structures in high seismic areas having such improved connections of precast building elements.

Structural beams subjected to lateral or axial loads in addition to gravity loads must be connected in a way that will transfer these loads through the connection to the support. Transfer of lateral loads between precast or prestressed concrete members can be troublesome. Examples of some such lateral loads include loads from earthquakes, vibratory machinery, moving vehicles and wind.

SUMMARY OF THE INVENTION

This invention is a connector used to transfer loads, such as lateral or axial loads, from one element to another, such as from a precast concrete beam to a concrete column. The connector includes a metal pin, normally of a round or rectangular cross section and an elastic grommet around the metal pin. The metal pin and grommet are affixed within an end portion of a girder or within a column ledge, with a portion of the metal pin protruding outwardly of the girder or the column ledge, this outwardly protruding portion being affixed or slidably mounted within a beam or girder connected to the girder or ledge, respectively, depending on the type of loads anticipated.

It is a primary object of the invention to provide a novel connector for precast concrete structural elements.

A further object is to provide a connector for precast concrete structural elements which is particularly adapted for use in meeting the structural requirements in high seismic areas.

A still further object is to provide a novel connector for precast concrete structural elements which will increase the load transfer capacity of the connection by a factor of about three times the capacity of a similar connection without the elastic grommet of the present invention.

BRIEF DESCRIPTION OF THE DRAWINGS

These and other objects and advantages will be more readily apparent when considered in relation to the preferred embodiments, as set forth in the specification, and shown in the drawings, in which.

DESCRIPTION OF THE PREFERRED EMBODIMENTS

Figure 1:
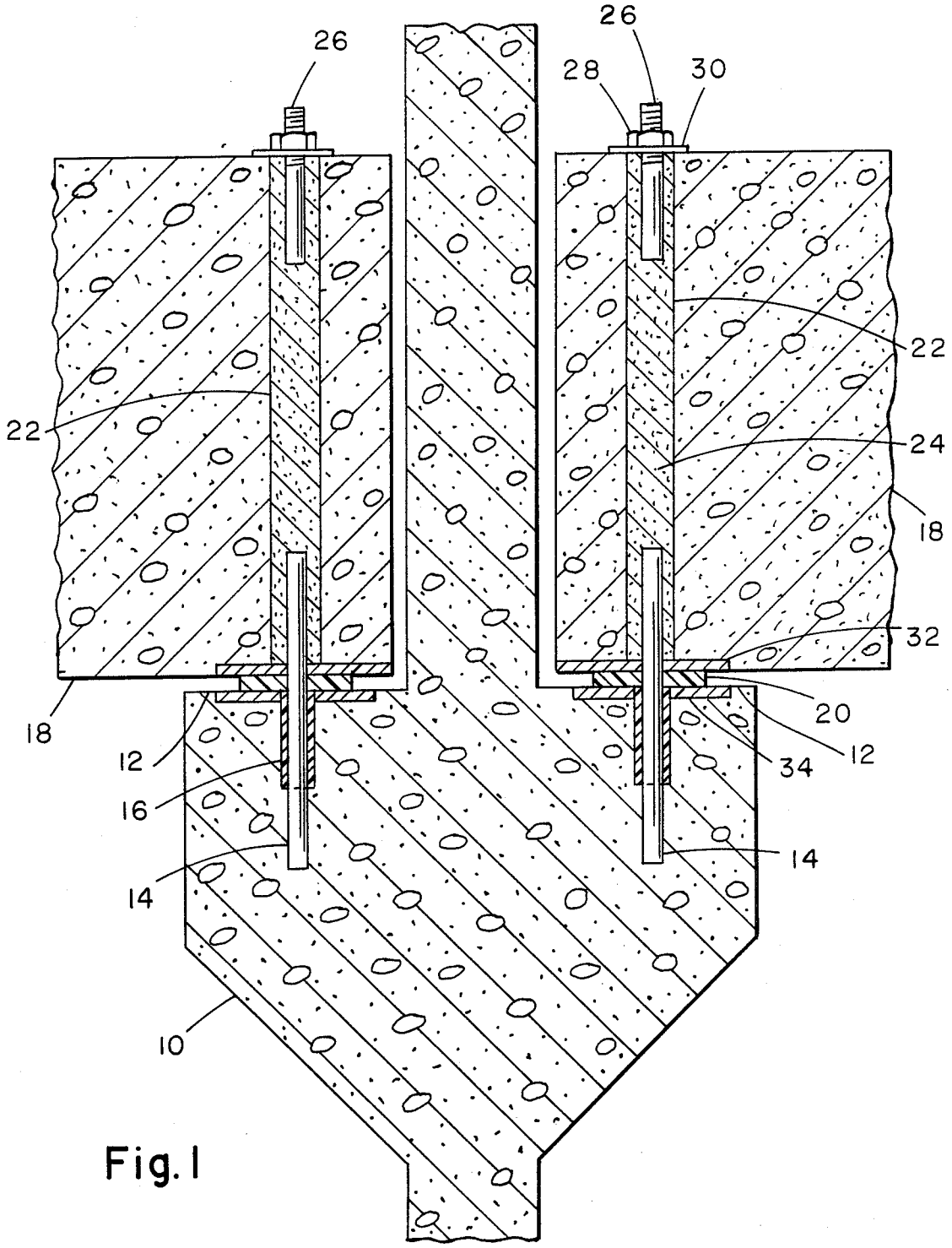
FIG. 1 is a vertical sectional view of a precast concrete column with opposed ledges affixed to and supporting oppositely directed precast concrete girders, all connected in accordance with the invention.

Referring to FIG. 1, there is shown a short section of a precast concrete column 10 which has been formed with two opposed ledges 12, 12. Also, cast in place within each ledge 12 is a metal pin 14 and an elastic grommet 16. Metal pin 14 is of about two inches in diameter and twenty-eight inches in length, with sixteen inches embedded within ledge 12 and one foot protruding upward out of ledge 12. The elastic grommet 16 is a 70 durometer neoprene sleeve, having a wall thickness of $\frac{3}{4}$ inch and being friction fit around the upper eight inches of the portion of metal pin 14 which is embedded within ledge 12.

Disposed upon, and supported by, each ledge 12 is a precast concrete girder 18, with a flexible bearing pad 20 disposed between ledge 12 and girder 18. A grout hole 22 is formed in girder 18 arranged to have located therewithin the upper one foot of metal pin 14, and of a diameter such that grout 24 within the hole 22 surrounds pin 14.

Hole 22 extends to the top of girder 18, to permit filling the hole with grout 24. A threaded rod 26 affixed within the top of hole 22 by grout 24, has a nut 28 and washer 30 sealing the top of grout hole 22. A metal heel plate 32 is firmly adhered to the bottom surface of girder 18, located to rest upon the bearing pad 20, and, preferably, cast in place during forming of the girder 18. A similar sole plate 34 is cast in place on ledge 12, for location under bearing pad 20.

Also cast in place in each girder 18 and in column 10, but not shown, are reinforcing rods, all located therewithin in accordance with known engineering principles.

Figure 2:
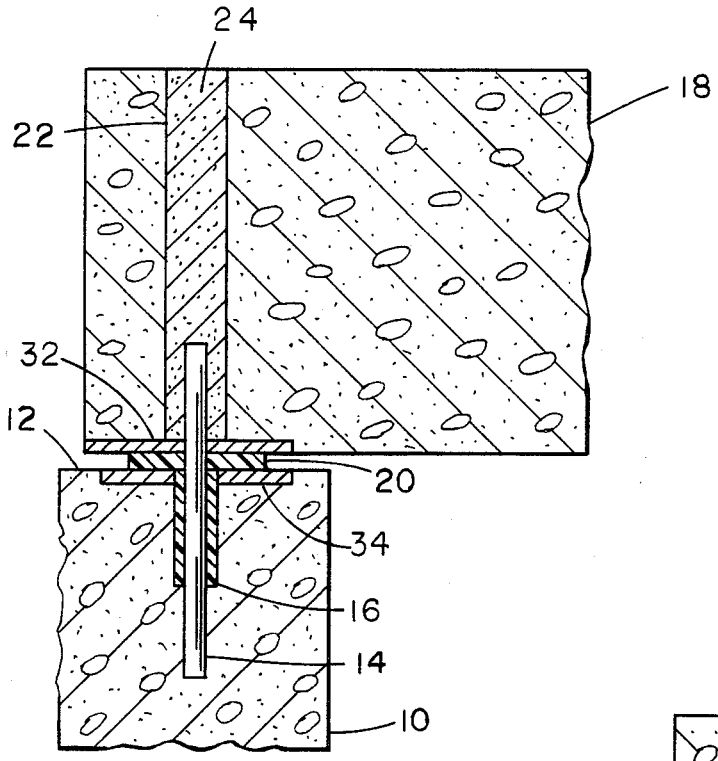
FIG. 2 is a diagrammatic view of the connection of FIG. 1.

FIG. 2 is a diagrammatic view of the structural connection shown in FIG. 1, including diagrammatically the elements which are essential in understanding the manner of transferring loads, including ledge 12, pin 14, grommet 16, girder 18, bearing pad 20, grout hole 22, grout 24, heel plate 32 and sole plate 34.

Figure 3:
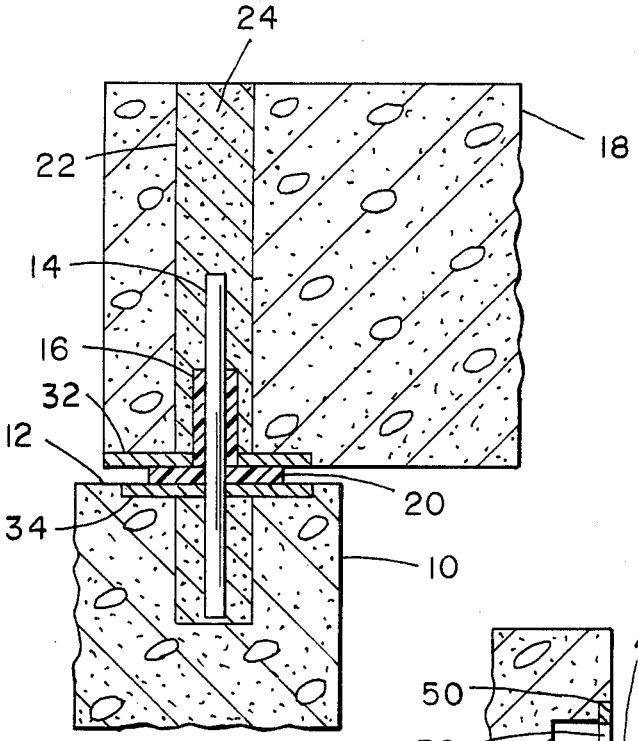

FIG. 3 is a modification of the connection of FIG. 2 wherein the grommet 16 is friction fit onto the portion of pin 14 which is disposed within the girder 18. In this embodiment the pin is preferably first affixed within ledge 12, by being cast in place therein or grouted into a hole formed therein. After placement of the girder 18 on ledge 12, with the pin 14 and grommet 16 extending into hole 22, grout 24 is placed in hole 22 and surrounds pin 14 and grommet 16.

The pin 14 and grommet 16, in the connection shown in FIGS. 1–3 transfers a horizontal force in any direction.

Figure 5:
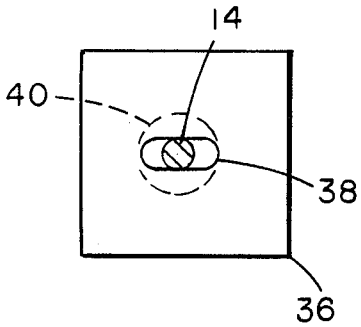
FIG. 5 is a bottom view of the girder of FIG. 4 showing the special heel plate with the pin extending therethrough.
Figure 4:
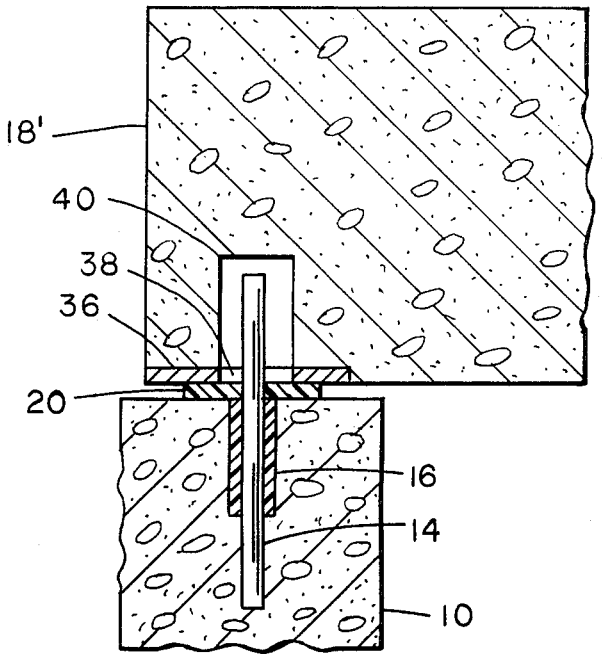
FIGS. 3, 4, and 6 are diagrammatic views similar to FIG. 2 of modifications of the connection, in accordance with the invention.

FIG. 4 shows a slip connection which transfers a horizontal force in only one direction. The sole plate is omitted. The heel plate 36 is specially made with an elongate hole 38, as shown in FIG. 5. Elongate hole 38 has a width which is equal to the diameter of pin 14 and a length which is equal to the diameter of the grout hole 40 in girder 18'. Elongate hole 38 has a long axis in the direction which pin 14 is to move freely without transferring any force, and grout hole 40 is either void or filled with a soft compressible material, such as loose vermiculite particles.

The structure of FIG. 4 could also be reversed, not shown, with the elastic grommet 16 located in girder 18', and with a sole plate having an elongate slot and a void hole therebelow, allowing movement of pin 14 in one direction, relative to ledge 12. With the elongate slot in a heel plate or a sole plate, movement is allowed in one direction, while forces normal to the axis of movement will be transferred from the girder 18' to the ledge 12.

Figure 6:
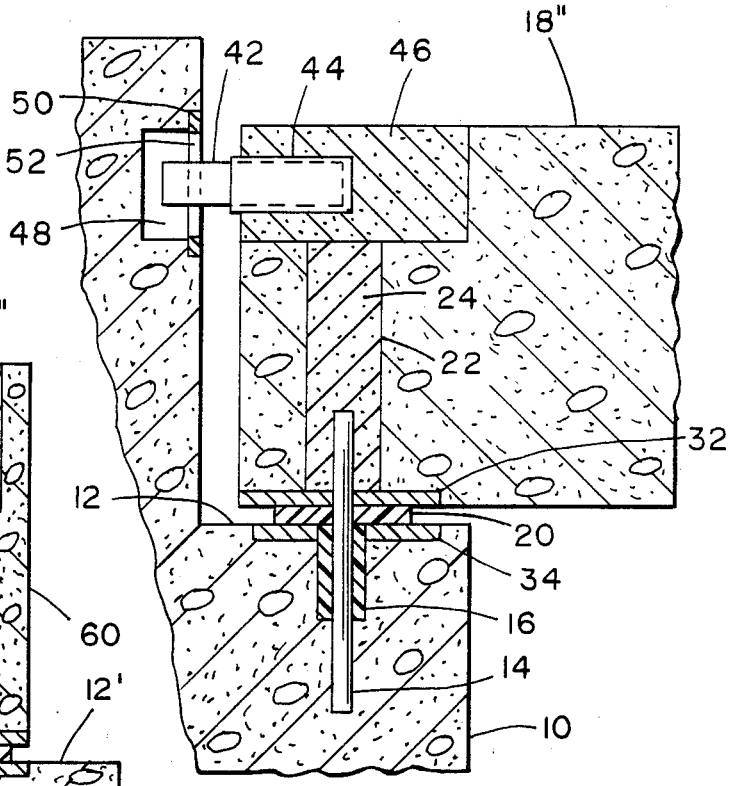

FIG. 6 shows a standard connection as in FIG. 2 used in combination with a top connection. This modification adds the function of restraining overturning of the girder 18'' due to a rotation about the longitudinal axis of the girder. The lower standard connection includes the ledge 12, pin 14, grommet 16, girder 18'', bearing pad 20, grout hole 22, grout 24, heel plate 32 and sole plate 34.

A flat pin 42, with an elastic grommet 44, is grouted in a preformed pocket 46 near the top of the girder 18'' and extends out from the end of the girder 18'', with the elastic grommet 44 surrounding the portion of pin 42 which is grouted into the girder 18''. The protruding portion of flat pin 42 extends into a pocket 48 in column 10, through a face plate 50 having a slot 52 aligned with the vertical axis of the girder 18''. Face plate 50 is affixed over the pocket 48. Pocket 48 can either be void or filled with a compressible material such as vermiculite particles. Flat pin 42 is thus free to move vertically within the slot 52, or in the direction of the longitudinal axis of the girder 18''.

The structure of FIG. 6 could also be modified by replacing the lower standard connection, with a lower connection such as the slip connection of FIG. 4.

Figure 7:
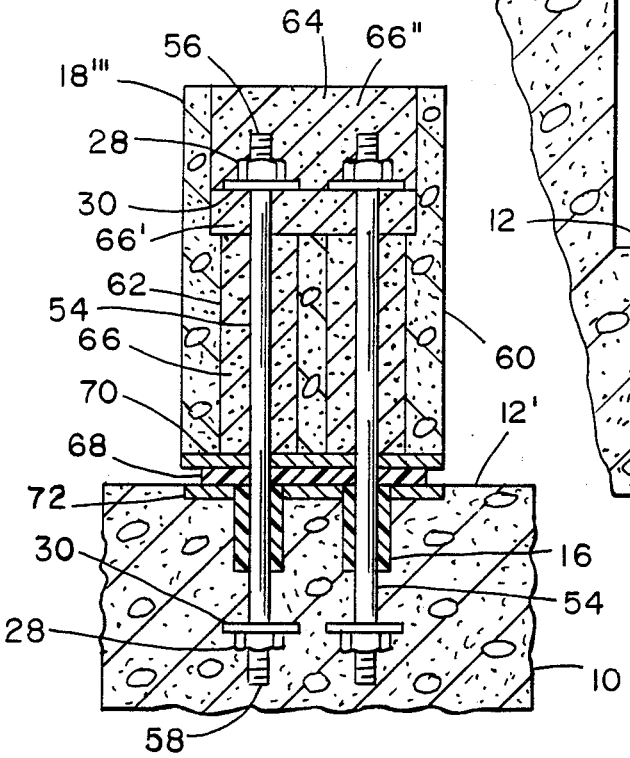
FIG. 7 is an end diagrammatic view of a girder, shown supported on a column ledge, with a still further modified form of the invention.

FIG. 7 is a diagrammatic end view of a girder 18''' with a modified connection wherein overturning is restrained, in accordance with the invention, by using a pair of metal pins 54, 54, each of which has a threaded top end 56 and a threaded bottom end 58. A nut 28 and a washer 30 is used as an anchor on each end. The bottom portion of each pin 54 is cast in place or grouted into ledge 12' with an elastic grommet 16 friction fit around an upper portion of that bottom portion in ledge 12'. The two pins 54, 54 are located equidistant from the end of girder 18''', side by side, each spaced in from a side 60 of girder 18''' a distance of about $\frac{1}{3}$ the width of girder 18'''.

Each pin 54 extends up through a grout hole 62 into a grout pocket 64 in girder 18'''. The grout hole 62 is filled with grout 66. The grout pocket 64 is also filled with grout 66. A lower portion 66' of the grout 66 in grout pocket 64 is allowed to set prior to the upper nut 28 and washer 30 being placed and tightened by turn of the nut 28, compressing a bearing pad 68 between girder 18''' and ledge 12'. The remainder of pocket 64 is then filled with grout 66''. A heel plate 70 and a sole plate 72 may also be affixed to the girder 18''' and the ledge 12', respectively.

Tests have shown that the use of the elastic grommet around the pin or pins used to make preformed concrete structure connections increases the load transfer capacity of the connection by a factor which is on the order of three times the capacity of a similar connection without the grommet. If engineering analysis indicates that more pins or multiple top connections are required, then the use of an elastic grommet for each pin or plate should be required, in accordance with the invention. The advantages of this invention are of particular importance in structures located in active seismic areas.

Having completed a detailed disclosure of the preferred embodiments of our invention, so that others may practice the same, we contemplate that variations may be made without departing from the essence of the invention.

We claim:

1. An improved connection of precast concrete elements comprising at least two precast cementitious concrete structural elements disposed in close load transferring positions, at least one metal pin extending from within one of said elements to within the second of said elements, said metal pin being held in place in each of said elements by a structure of the group consisting of (1) being cast in place in said cementitious concrete element, (2) being disposed in a grout hole which has been filled with a cementitious grout and (3) being disposed in a pocket formed behind a slotted plate affixed to said element which restricts movement in all but one direction, said metal pin being held in place in at least one of said elements by a structure of the class consisting of (1) and (2), and said metal pin having an elastic grommet disposed between a portion of the pin and the surrounding cementitious concrete or grout in one of the elements wherein said pin is held in place by a structure of the class consisting of (1) and (2), said elastic grommet being disposed on the portion of said pin immediately adjacent the joint between said two elements and between a portion of the pin and the adjacent cementitious concrete or grout through which a load is to be transferred from one element to the other.

2. An improved connection of precast concrete elements as defined in claim 1 wherein one said concrete element is a horizontally extending beam and the second said concrete element is a column having a ledge on which the end of said beam is supporting, said beam being connected to said ledge by a pair of metal pins extending vertically from within said ledge into the bottom of said beam, said two metal pins each being similarly held in place by the structure as defined in claim 1 relative to the at least one pin of said claim 1, said two metal pins being disposed in spaced parallel side by side relation in said beam whereby overturning of said beam is prevented.

3. An improved connection of precast concrete elements as defined in claim 1 wherein said metal pin is cylindrical and said elastic grommet is a tubular sleeve.

4. An improved connection of precast concrete elements as defined in claim 3 wherein said elastic grommet is about eight inches in length and disposed on a portion of said metal pin adjacent the joint between said concrete elements.

5. An improved connection of precast concrete elements as defined in claim 3 wherein said metal pin is of about two inch diameter and said elastic grommet is of about two inch inside diameter and about three and a half inch outside diameter.

6. An improved connection of precast concrete elements as defined in claim 5 wherein said elastic grommet is a neoprene tubular sleeve of about 70 durometer neoprene.

7. An improved connection of precast concrete elements as defined in claim 1 wherein said metal pin is a flat rectangular plate having a first end extending lengthwise into a first concrete element and held in place therein by a structure of the class consisting of (1) and (2), and a second end extending into a second concrete element, said first end having an elastic grommet on at least part of those portions of the plate-shaped pin through which loads are to be transferred from one concrete element to the other.

8. An improved connection of precast concrete elements as defined in claim 7 wherein said plate-shaped pin second end extends through a slotted plate affixed to said second concrete element having a slot length greater than the width of said plate-shaped pin, and a slot width substantially equal to the thickness of said plate-shaped pin.

9. An improved connection of precast concrete elements as defined in claim 7, wherein said second concrete element is a column having a ledge and wherein said plate-shaped pin extends horizontally from said first concrete element into the vertical face of said column.

10. An improved connection of precast concrete elements as defined in claim 9 wherein said plate-shaped pin second end extends through a slotted plate affixed to said second concrete element having a slot length greater than the width of said plate-shaped pin, and a slot width substantially equal to the thickness of said plate-shaped pin.

11. An improved connection of precast concrete elements as defined in claim 9 wherein said second concrete element is supported on said ledge and is connected by a second metal pin extending from within said ledge up into the bottom of said second concrete element, said second pin having an elastic grommet disposed between a portion of the pin and the surrounding cementitious grout in one of the elements wherein said second pin is held in place by a structure of the class consisting of (1) and (2), said elastic grommet on said second pin being disposed on the portion of said pin immediately adjacent the joint between said two elements and between a portion of the pin and the adjacent cementitious concrete or grout through which a load is to be transferred from one element to the other.

12. An improved connection of precast concrete elements as defined in claim 11 wherein said plate-shaped pin second end extends through a slotted plate affixed to said second concrete element having a slot length greater than the width of said plate-shaped pin, and a slot width substantially equal to the thickness of said plate-shaped pin.

* * * * *